United States Patent [19]

Platt et al.

[11] Patent Number: 4,926,607

[45] Date of Patent: May 22, 1990

[54] COMPRESSION LEG

[75] Inventors: William J. Platt, Collingdale, Pa.; Thomas E. Rose, Dunwoody, Ga.

[73] Assignee: National Rolling Mills, Inc., Frazer, Pa.

[21] Appl. No.: 393,355

[22] Filed: Aug. 14, 1989

[51] Int. Cl.[5] ..... E04B 5/55
[52] U.S. Cl. ..... 52/484
[58] Field of Search ..... 52/484, 486

[56] References Cited

U.S. PATENT DOCUMENTS

| | | | |
|---|---|---|---|
| 3,842,561 | 10/1974 | Wong | 52/484 |
| 3,964,218 | 6/1976 | Ho | 52/484 |
| 4,084,364 | 4/1978 | Jones | 52/484 |

*Primary Examiner*—David A. Scherbel
*Assistant Examiner*—Michele A. VanPatten
*Attorney, Agent, or Firm*—Eugene Chovanes

[57] ABSTRACT

A compression leg that is applied to the hanger wire of a suspended grid ceiling. The leg is formed with a cross section having a portion intended to envelop the wire, and a channel portion that guides the leg into place about the wire. The leg is of rigid metal, and is crimped to the wire.

4 Claims, 1 Drawing Sheet

COMPRESSION LEG

BACKGROUND OF THE INVENTION

This invention relates to a suspended ceiling grid structure having cross tees and main beams that support ceiling tiles, or other ceiling surfaces. A ceiling of this type is shown in U.S. Pat. No. 4,785,603. Such structure is suspended from a structural ceiling, or structural bars or ceiling joists, by hanger wires. The weight of the grid structure and tiles, or other surface, keeps the hanger wires in tension, and no downward movement is generally possible.

The wires do not, to any substantial degree, resist upward movement of the grid, or compression of the wires, so that it is possible for the ceiling or segments thereof to move upward under the influence of upward forces in the ceiling.

SUMMARY OF THE PRESENT INVENTION

Compression-resistant legs of the same length as the hanger wires which are capable of being applied after the ceiling and wires have been installed, are provided. Such legs block upward movement of the ceiling.

A leg, in cross section, has a circular portion intended to envelope the wire and provide a tubular column effect around the wire. The tubular portion is open at a segment of its wall that is integral with a converging channel portion. The circular and channel portions extend together longitudinally. The converging channel serves to guide the leg in its placement about the wire, and also further provides a stiffening effect to the leg.

The leg is suitably crimped to the wire at its ends to securely fasten the leg to the wire. The effect of using the leg of the invention in the manner described is to convert a tension member, the wire, into a tension and compression member, in a simple and effective manner.

DETAILED DESCRIPTION OF THE DRAWINGS

Figure 1:
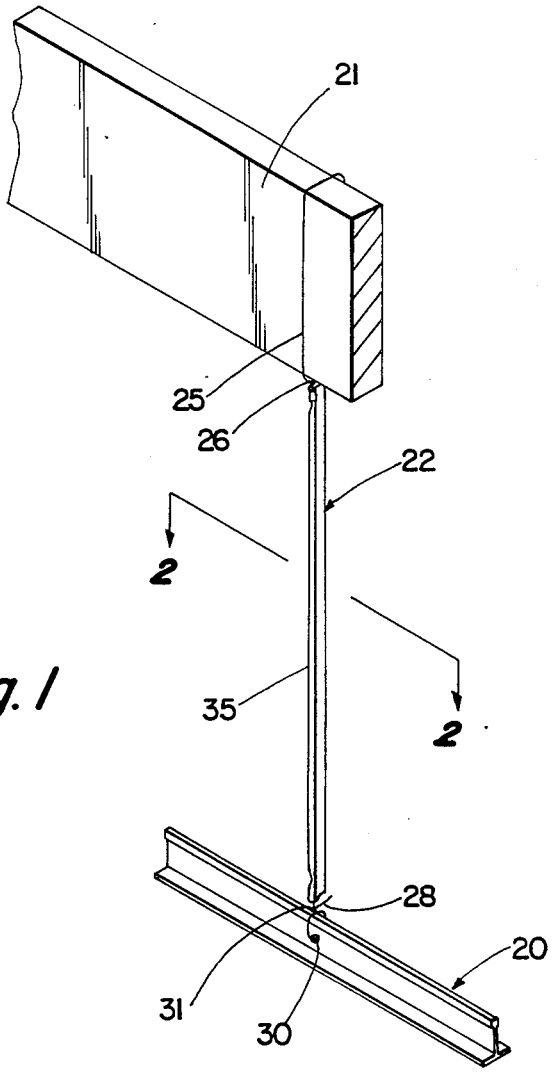
FIG. 1 is a schematic, perspective view of the leg in place about a hanger wire supporting a suspended ceiling.

As seen in FIG. 1, a grid member 20 of T-shape cross section is supported from a bar or ceiling joist 21 by support element 22. Grid member 20 is a segment of a suspended ceiling having intersecting grid members and ceiling tiles, as is well known, and as shown, for instance, in the aforementioned U.S. Pat. No. 4,785,603. It should be understood that the grid can be used to support other ceiling surfaces, rather than tiles, such as boards, or a plastered surface. The boards may be secured by screws or other fasteners to the grid, and the joints taped or plastered. In the alternative, a metallic screen may be secured to the grid and the ceiling plastered. Such ceiling constructions are well known in the prior art and can form either interior or exterior ceilings.

Ceiling joist 21 is merely shown as representative of a horizontally extending structural member. Such member can, for instance, be a structural ceiling which is the floor of the next upper building level.

Support element 22 has a component thereof, a hanger wire 25, the use of which is well known in the prior art. Such wire 25 is a relatively flexible metallic single strand element and is applied by first cutting a suitable length to provide for the proper ceiling height, and then fastening the wire 25 at its upper end 26 about a ceiling joist 21 and then twisting the wire 25 about itself to secure it to the joist 21. Alternatively, the upper end 26 of the hanger wire 25 can be securely directed to a structural ceiling or the like with an anchor fastener as is well known. The lower end 28 of the hanger wire 25 is passed through a hole 30 formed in grid member 20 and again twisted at 31 to secure the wire 25 to the grid member 20. A plurality of wires 25 are so attached to the suspended ceiling to hang the ceiling. Hanger wires 25 are commonly used in this fashion in the prior art.

After a hanger wire 25 is so applied, the compression leg 35 of the invention is applied and forms a second component of support element 22.

Leg 35 is formed of, for instance, low carbon steel 1/32" in thickness. The leg 35 has, in cross section, a tubular portion 36 having an open segment in its circumference that has integral therewith a converging channel portion 37 extending longitudinally along the tubular portion 36. The inner diameter of the tubular portion 36 may be for instance ¼", and each of the channel sides 38 extend radially outwardly from the tubular portion 36 for approximately ½". The channel portion 37 may converge for a width of 5/16" at its inlet to a ⅛" opening at the tubular portion 36. The leg 35 can be roll-formed or otherwise shaped into extended lengths, and then field cut to a length generally equal to the distance from the ceiling joist 21, or other upper structural support, to the top of the grid member 20.

Figure 2:
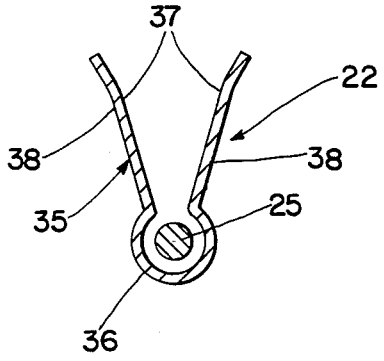
FIG. 2 is a cross section of the leg and wire taken on the line 2—2 in FIG. 1.

The leg 35 is simply applied about hanger wire 25 by bringing the leg 35 parallel to the wire 25, and laterally passing the converging channel 37 about the wire 25, so that the leg 35 comes to rest about the wire 25 in the position shown in FIGS. 1 and 2, to form support element 22. In this position, leg 35 abuts at its upper end against ceiling joist 27 or other structural member, and the lower end of the leg 35 rests against grid member 20. The upper and lower ends of the leg 35 are then crimped against hanger wire 25, as with a pair of pliers, to secure the leg 35 to the wire 25 in the position shown in the Figures.

The resultant support element 22 now substantially resists not only downward movement of the ceiling by means of the hanger wire 25, but also upward movement of the ceiling by means of compression leg 35.

Such a result is accomplished by simply adding the device of the invention to the same structure and construction used in the prior art. Such device is simple to construct and apply, and is effective in use.

We claim:

1. For use with a ceiling construction having (a) a suspended ceiling formed of grid members and a ceiling surface secured to such grid, (b) a structural member above the suspended ceiling for supporting the suspended ceiling, and (c) hanger wires extending longitudinally in tension between and connected to the structural member and the grid members for hanging the suspended ceiling from the structural member, an improvement applied to a hanger wire after the wire is in place in the ceiling construction, comprising a fixed length compression leg extending longitudinally from the structural member to the grid member and having a tubular portion that envelopes the hanger wire, and a longitudinally extending slot in the tubular portion that permits the leg to be applied in a lateral direction to the wire, wherein the leg forms a resistance to upward movement of the ceiling.

2. A leg of claim 1 wherein the leg is secured to the wire by a crimp.

3. A leg of claim 1 wherein the leg has a channel portion extending parallel to the tubular portion and integral therewith, wherein the channel portion guides the leg about the wire in applying the leg to the wire.

4. A leg of claim 3 wherein in cross section the channel portion converges toward the tubular portion.

* * * * *